US009421727B2

(12) United States Patent
Deraas et al.

(10) Patent No.: US 9,421,727 B2
(45) Date of Patent: Aug. 23, 2016

(54) COIL SPRING COMPACTOR

(71) Applicant: Olaf Industries, Inc., Duluth, MN (US)

(72) Inventors: Clint Deraas, Duluth, MN (US); Eugene Luoma, Duluth, MN (US)

(73) Assignee: Olaf Industries, Inc., Duluth, MN (US)

( * ) Notice: Subject to any disclaimer, the term of this patent is extended or adjusted under 35 U.S.C. 154(b) by 0 days.

(21) Appl. No.: 14/306,129

(22) Filed: Jun. 16, 2014

(65) Prior Publication Data

US 2014/0290506 A1 Oct. 2, 2014

Related U.S. Application Data

(62) Division of application No. 12/724,320, filed on Mar. 15, 2010, now abandoned.

(60) Provisional application No. 61/266,143, filed on Dec. 2, 2009, provisional application No. 61/160,252, filed on Mar. 13, 2009.

(51) Int. Cl.

| | |
|---|---|
| ***B30B 13/00*** | (2006.01) |
| ***B30B 9/32*** | (2006.01) |
| ***B30B 9/00*** | (2006.01) |
| ***B30B 7/04*** | (2006.01) |
| ***B30B 9/30*** | (2006.01) |

(52) U.S. Cl.

CPC ... *B30B 9/00* (2013.01); *B30B 7/04* (2013.01); *B30B 9/3078* (2013.01); *B30B 9/327* (2013.01); *B30B 13/00* (2013.01)

(58) Field of Classification Search

CPC ..... B30B 9/3003; B30B 9/3032; B30B 7/04; B30B 9/3078; B30B 9/327; B30B 9/00; B30B 9/3021; B30B 9/3057; B30B 9/32; B30B 13/00; B65B 27/12

USPC ..... 100/2, 3, 35, 42, 214, 215, 232, 240, 100/244, 245

See application file for complete search history.

(56) References Cited

U.S. PATENT DOCUMENTS

| | | | | |
|---|---|---|---|---|
| 1,987,762 | A | | 1/1935 | Symons |
| 2,966,816 | A | | 1/1961 | White |
| 3,000,295 | A | * | 9/1961 | Fenton ..... 100/214 |
| 3,082,588 | A | | 3/1963 | Jay et al. |
| 3,353,478 | A | | 11/1967 | Hopkins |
| 3,408,927 | A | | 11/1968 | Willock |
| 4,214,519 | A | | 7/1980 | Stollenwerk et al. |
| 4,450,764 | A | | 5/1984 | Montgomery |
| 4,487,120 | A | | 12/1984 | Barstow |
| 4,573,403 | A | | 3/1986 | Van Doorn et al. |
| 5,001,975 | A | | 3/1991 | Finden |

(Continued)

OTHER PUBLICATIONS

United States Patent and Trademark Office, Office Action mailed Mar. 14, 2014 in U.S. Appl. No. 12/724,320, 11 pages.

(Continued)

*Primary Examiner* — Jimmy T Nguyen

(74) *Attorney, Agent, or Firm* — Inskeep IP Group, Inc.

(57) ABSTRACT

A compactor that compresses springs in at least two, preferably three different directions. One compression is achieved through actuation of a crush chamber door. At least two of the three directions of compression are perpendicular to an axis through the springs. After the final compression is performed, the compressed springs are discharged from the crush chamber in a direction parallel to the direction of the final compression.

5 Claims, 8 Drawing Sheets

(56) References Cited

U.S. PATENT DOCUMENTS

| | | | | |
|---|---|---|---|---|
| 5,146,848 | A | 9/1992 | Dufour | |
| 5,201,266 | A | 4/1993 | Schmalz et al. | |
| 5,203,261 | A | 4/1993 | Davis | |
| 5,207,994 | A | 5/1993 | Suzuki et al. | |
| 6,360,655 | B1 | 3/2002 | Crespo Barrio | |
| 7,024,992 | B2 | 4/2006 | Johnson | |
| 7,077,060 | B2 | 7/2006 | Eriksen | |
| 7,210,404 | B2 | 5/2007 | Minamoto et al. | |
| 7,421,946 | B1 | 9/2008 | Pontus et al. | |
| 2001/0036449 | A1* | 11/2001 | Garst | 424/78.04 |
| 2008/0061121 | A1 | 3/2008 | Railsback | |
| 2011/0036449 | A1* | 2/2011 | Taylor | B30B 9/3021 140/89 |

OTHER PUBLICATIONS

United States Patent and Trademark Office, Final Office Action mailed Apr. 9, 2013 in U.S. Appl. No. 12/724,320, 10 pages.

United States Patent and Trademark Office, Office Action mailed Aug. 20, 2012 in U.S. Appl. No. 12/724,320, 10 pages.

WIPO, International Search Report dated Jul. 6, 2010 in International Patent Application No. PCT/US10/27348, 3 pages.

http://www.mattressrecycling.biz/xpp_art.shtml, "Spring Compactor—Patent Pending," Table of Contents of site containing individual pages of provisional patent application by Cecil Ray Taylor, Independence, Missouri; see all web pages linked on this page; accessed Oct. 6, 2010, 2 pages.

* cited by examiner

COIL SPRING COMPACTOR

RELATED APPLICATIONS

This application is a divisional of and claims priority to U.S. patent application Ser. No. 12/724,320 filed Mar. 15, 2010 entitled Coil Spring Compactor, which claims priority to U.S. Provisional Application Ser. No. 61/266,143 filed Dec. 2, 2009, entitled Coil Spring Compactor and U.S. Provisional Application Ser. No. 61/160,252, filed Mar. 13, 2009, entitled Coil Spring Compactor, the contents of both of which are incorporated in their entirety herein.

FIELD OF THE INVENTION

This application relates to an apparatus and method for compacting springs and, more particularly, to an apparatus and method for compacting and preparing the metal components of mattresses for recycling.

BACKGROUND OF THE INVENTION

Modern mattresses are made from various combinations of materials including: synthetic and natural fabrics, feathers, foam, plastics, wood, and arrangements of metal springs. The disposal and recycling of mattresses is a complicated process that involves both separating the various mattress materials from each other and also preparing each of the resulting materials in a bundle that meets the specific acceptance requirements of the various recyclers. For example, the metal springs of mattresses form an interconnected array of metal that occupies a relatively large area at a low density. Metal foundries, however, accept metal in relatively small volume, high-density units, for example one cubic foot units or blocks of approximately 60 to 100 pounds. Efficient systems and methods for compacting resilient springs to such densities have thus far not been developed in the field. Accordingly, there exists a need to efficiently process low-density mattress springs into high-density units accepted by typical foundries.

OBJECTS AND SUMMARY OF THE INVENTION

The present invention addresses this need by providing systems and methods for efficiently compacting the springs of mattresses and box springs. The present invention compresses the springs in at least two, preferably three different directions. One compression is achieved through actuation of a crush chamber door. At least two of the three directions of compression being perpendicular to an axis through the springs. After the final compression is performed, the compressed springs are discharged from the crush chamber in a direction parallel to the direction of the final compression.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
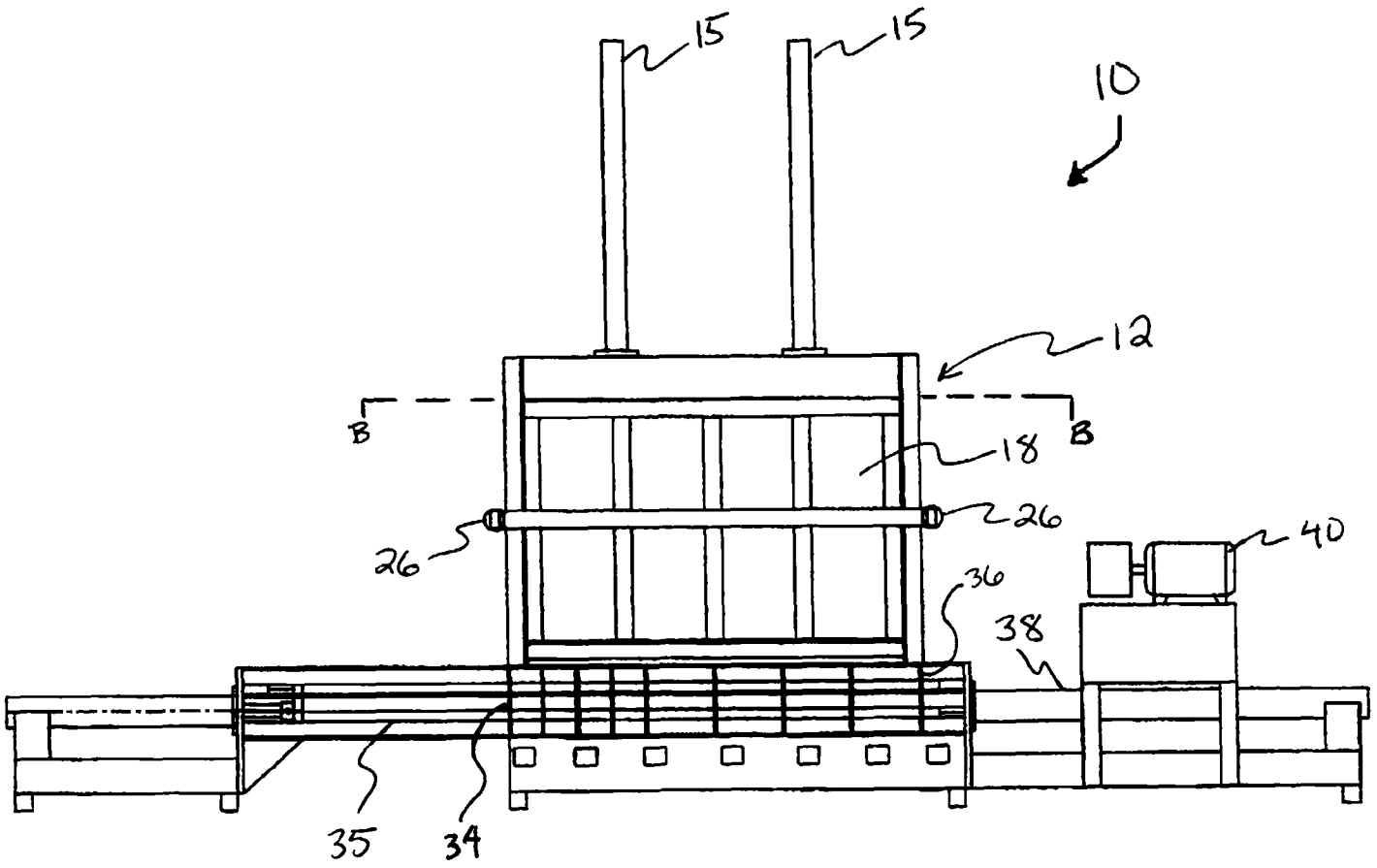
FIG. 1 is a front elevation view of a spring compactor according to certain embodiments of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The coil spring compactor of the present invention is operable to simultaneously compact a plurality of springs from mattresses and/or box springs into a compressed unit that is of a density accepted by commercial metal foundries. For example, in a preferred embodiment, the compactor of the present invention compacts four mattress springs into a 12 inch wide by 6 inch high by 18 inch long mass of approximately 60 to 100 pounds, preferably 75 pounds.

As shown in FIGS. 1-7, in certain embodiments of the present invention, a coil spring compactor 10 employs a six sided magazine or crush chamber 12. The crush chamber is approximately rectangular having a height and width dimensioned so as to accept at least the springs from a king size mattress or box springs. The internal dimensions of the crush chamber 12 may, for example, be 78 inches high by 88 inches wide by 12 inches deep.

As shown in FIGS. 2A, 2B, 4A, 4B, and 5, the upper most horizontal surface of the crush chamber 12 employs one or more vertical compression plates 14. The vertical compression plates 14 are attached to or otherwise associated with one or more vertical compression hydraulic cylinders 15 or other similar means to vertically transpose the vertical compression plate through crush chamber 12. In embodiments employing more than one vertical compression hydraulic cylinders 15, it will be necessary to maintain the vertical compression plate 14 level relative to the different compression hydraulic cylinders 15. In one embodiment, the vertical compression plate 14 is maintained level by plumbing the hydraulic system from one of the vertical compression hydraulic cylinders 15 into the hydraulic system of the other vertical compression hydraulic cylinder 15. Alternatively, the vertical compression plate 14 and the vertical compression hydraulic cylinders 15 may incorporate either a mechanical or electrical level control system. For example, the coil spring compactor 10 may employ a programmable electronic leveling system combined with fluid control valves to provide constant vertical compression plate 14 leveling. The lower most horizontal surface, the surface opposite the vertical compression plates 14, employs a vertical compression counter surface 16, shown in FIGS. 5-7.

As shown in FIGS. 1-5 and 7, a chamber door 18 forms at least a portion of one of the large vertical sides of the crush chamber 12 when the chamber door 18 is in a closed state, shown in FIGS. 1, 2A, 3, 4B, and 7. The chamber door 18 employs a hinge 20 on a lower side 22 of the chamber door 18, see FIG. 5. When the chamber door 18 is opened, shown in FIGS. 2B, 4A, and 5, the upper side 24 of the chamber door 18 is transposed in an arc-like form 19 away from the crush chamber 12 and downward. When fully opened, chamber door 18 forms an approximately horizontal surface extending approximately perpendicular from the crush chamber 12. In the open position, the camber door 18 functions as a spring loading platform. In certain embodiments, the arc-like form 19 reflects the outline of chamber door side walls (not shown) that are employed on either side of the chamber door 12. The chamber door side walls are attached to the crush chamber 12 such that the side walls function to guide the springs loaded onto the open chamber door 18 into the crush chamber 12 when the chamber door 18 is transitioning from the open state to the closed state.

Figure 2B:
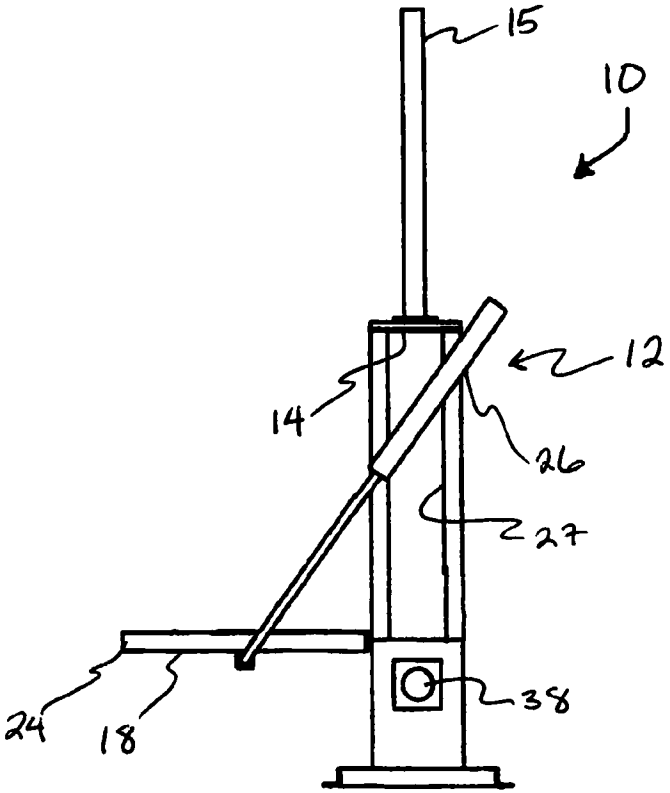
FIGS. 2A and 2B are side elevation views of a spring compactor according to certain embodiments of the present invention.
Figure 2A:
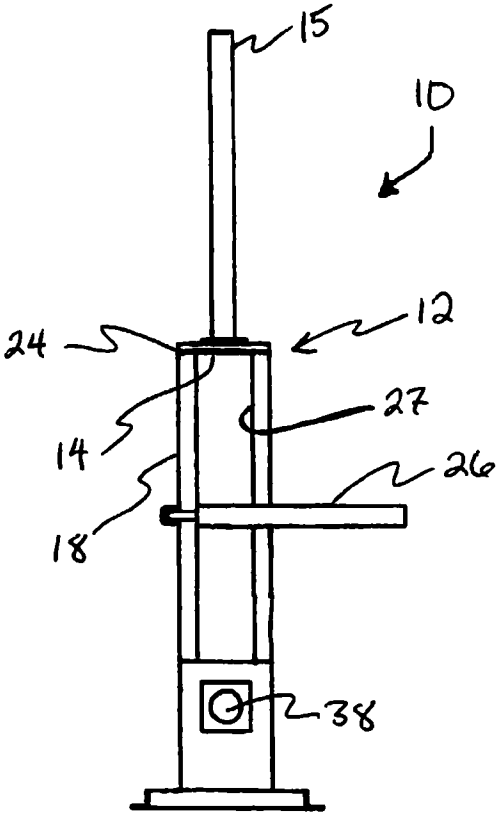
Figure 3:
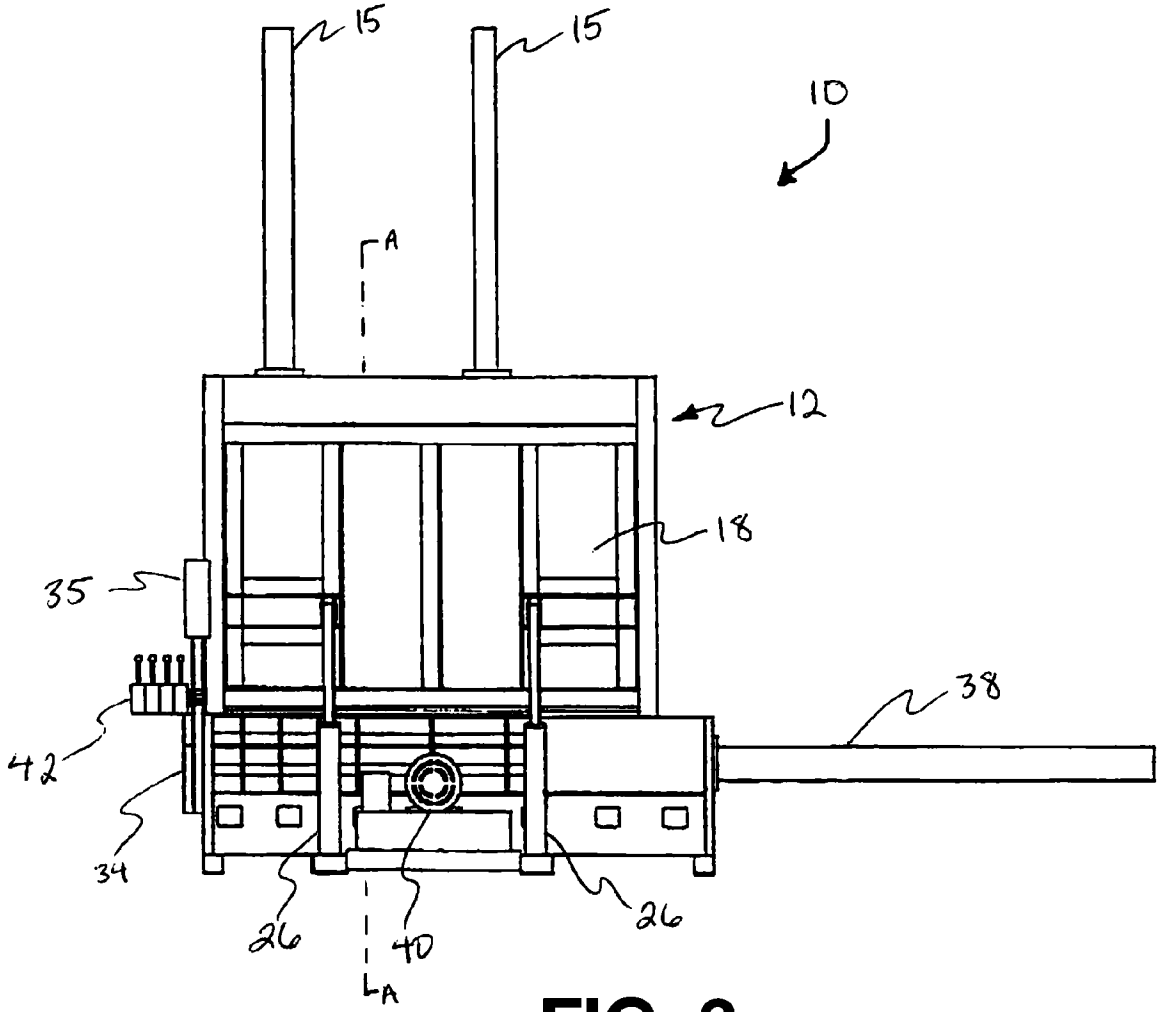
FIG. 3 is a front elevation view of a spring compactor according to certain embodiments of the present invention.
Figure 4B:
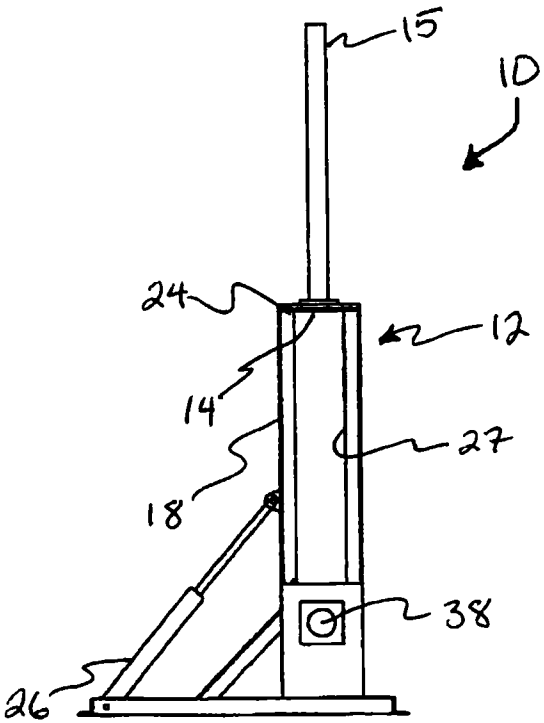
FIGS. 4A and 4B are side elevation views of a spring compactor according to certain embodiments of the present invention.
Figure 4A:
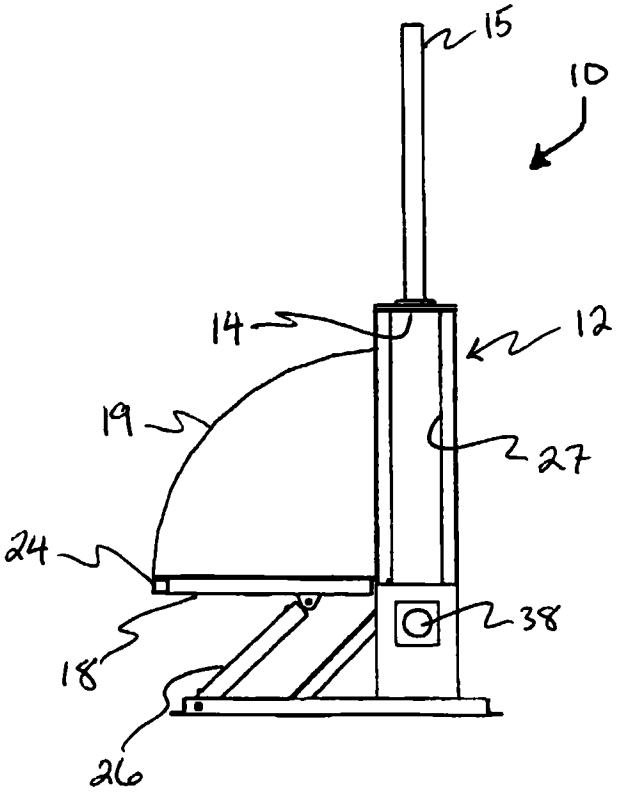
Figure 5:
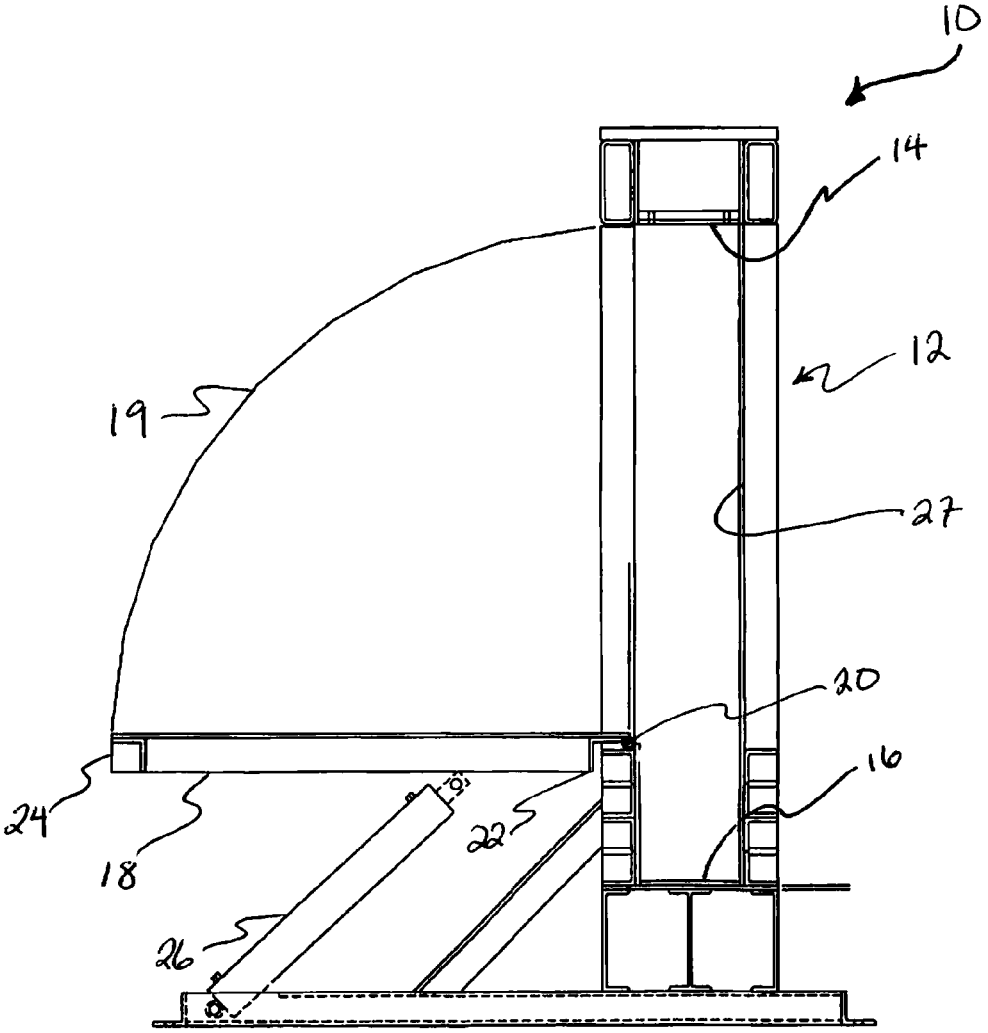
FIG. 5 is a sectional view taken along lines A-A of FIG. 3 of a spring compactor according to certain embodiments of the present invention.
Figure 6:
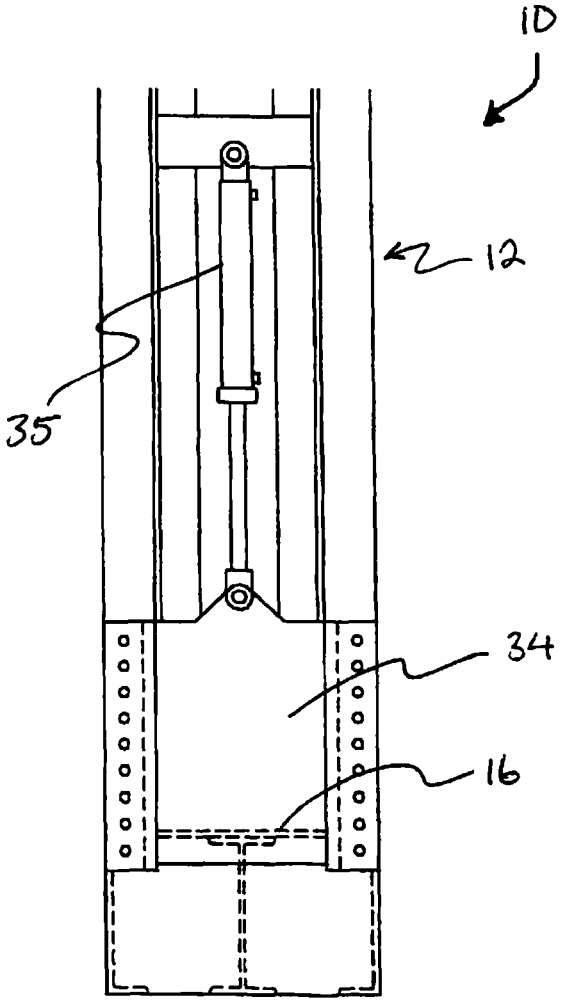
FIG. 6 is a side elevation view of a spring compactor according to certain embodiments of the present invention.

The chamber door 18 may be actuated, or opened and closed, by employing one or more chamber door hydraulic cylinders 26. The chamber door hydraulic cylinders 26 may be anchored to the exterior sides of the crush chamber 12 and chamber door 18, as shown in FIGS. 1-2B, or may be anchored on a frame residing on a floor or other work surface and to central locations on an exterior surface of the chamber door 18, as shown in FIGS. 3-5. The chamber door 18 may, for example, be 61 inches high by 88 inches wide. The second large vertical side of the crush chamber 12 employs a chamber door counter surface 27, shown in FIGS. 2A, 2B, 4A, 4B, 5 and 7.

Figure 7:
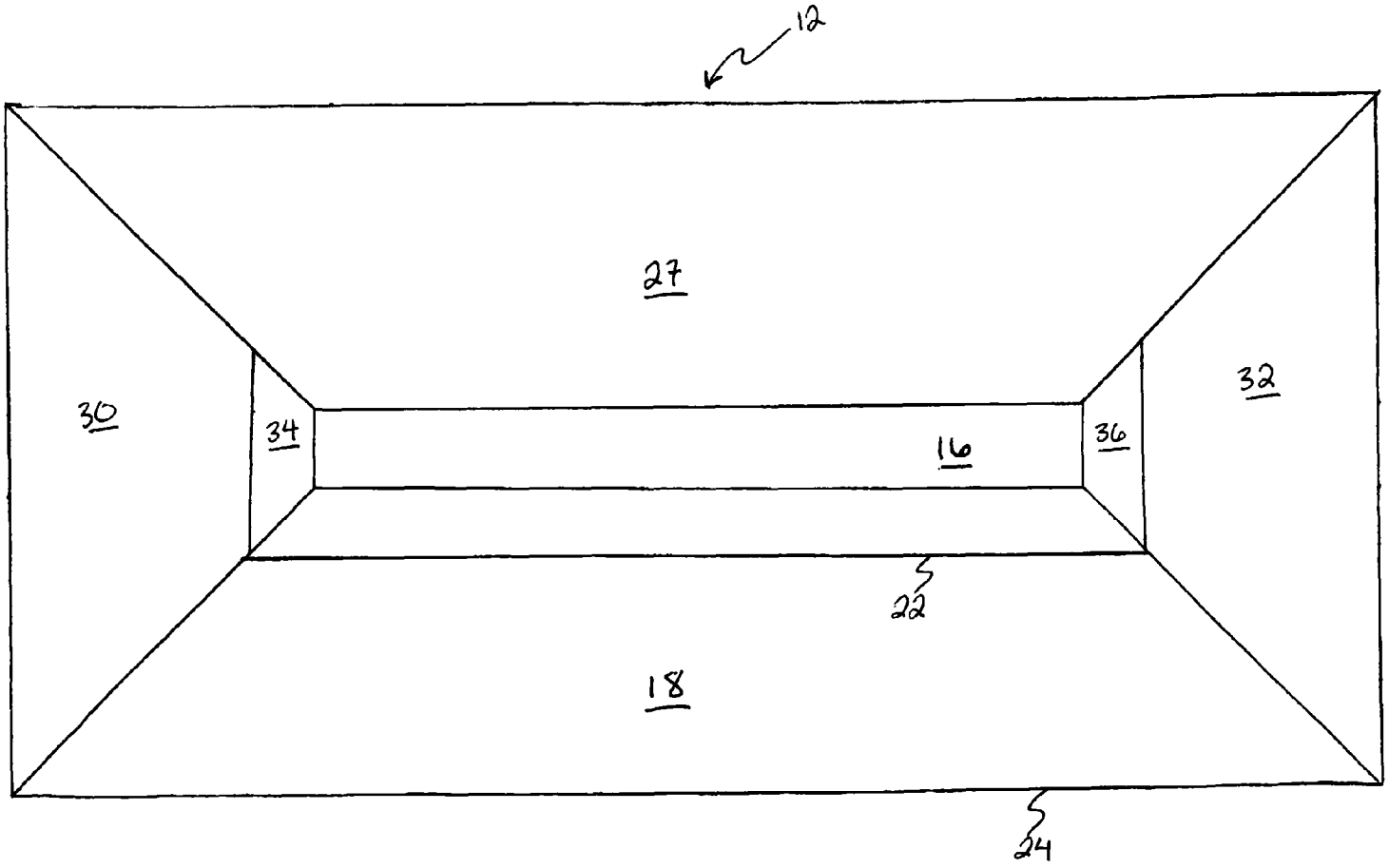
FIG. 7 is a sectional view taken along lines B-B of FIG. 1 of a spring compactor according to certain embodiments of the present invention.

The remaining two sides of the crush chamber 12 are the two small, vertical sides located opposite each other and form the first end surface 30 and the second end surface 32. As shown in FIG. 7, the first and second end surfaces 30 and 32 extend downwards along the sides of the crush chamber 12 to a discharge door 34 and a horizontal compression plate 36, respectively. The horizontal compression plate 36 is attached to or otherwise associated with a horizontal compression hydraulic cylinder 38 which functions to transpose the horizontal compression plate 36 horizontally through a lower portion of the crush chamber 12. The discharge door 34, located opposite the horizontal compression plate 36, counters the horizontal movement of the horizontal compression plate 36. The discharge door 34 is transposable so as to form an opening into a lower portion of the crush chamber 12. The discharge door 34 may be actuated by employing a discharge door hydraulic cylinder 35 or other similar means of transposing. In certain embodiments of the present invention, a discharge hydraulic cylinder 35 is employed so as to transpose the discharge door 34 horizontally away from the crush chamber 12, as shown in FIG. 1. In certain other embodiments, the discharge door hydraulic cylinder 35 is configured so as to transpose the discharge door 34 vertically along an exterior of the first end surface 30, shown in FIGS. 3 and 6.

It will be appreciated by those of skill in the art that interior surfaces of the crush chamber 12 will be subjected to significant resistance and subsequent wear during operation. In order to improve the longevity of the interior surfaces, in certain embodiments of the present invention, the interior surfaces of the crush chamber 12 employ, for example, abrasive resistant steel plates. In certain other embodiments, the interior surfaces of the crush chamber 12 are designed such that the individual components may be rotated, reversed, or interchanged with other interior surface components such that specific portions of the surfaces subject to disproportional wear may be moved to areas of less wear are without altering the operability of the coil spring compactor 10. For example, the wear plates forming the first end surface 30 and the second end surface 32 may be substantially identical and therefore interchangeable. If, for example, the first end surface 30 is worn more extensively than the second end surface 32, the two surfaces can be interchanged so as to maximize the use of both surfaces. Furthermore, the individual surfaces may be designed such that the surface, for example the chamber door counter surface 26, can be rotated 180 degrees and remounted with the same surface forming the interior surface or may be reversed such that the interior and exterior surfaces are reversed. In order to facilitate these features the interior surfaces of the crush chamber 12 may have symmetrical shapes, such as rectangular shapes, and symmetrical mounting means, for example equally spaced threaded holes.

Figure 8:
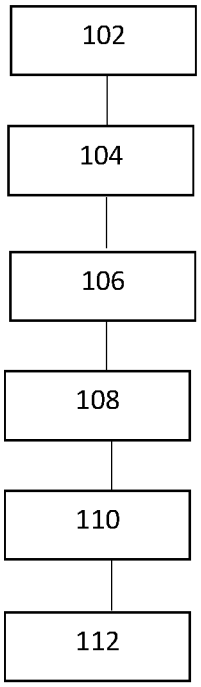
FIG. 8 is a flow diagram of a method for preparing springs from a mattress and/or box spring for processing by a foundry according to certain embodiments of the present invention.

With reference to FIG. 8, in a step 102 of a method for preparing springs from a mattress and/or box spring from processing by a foundry according to the present invention, the springs from dismantled mattresses are separated from non-spring elements of the mattress or box spring. In a step 104, the springs are then placed horizontally onto an elevated planar surface formed by an open chamber door 18, shown in FIGS. 2A, 2B, 4A, 4B, and 5. In a step 106, the chamber door 18 is then closed to form at least a portion of one side of the crush chamber 12. Closing the chamber door 18 positions the mattress springs approximately vertically upon their long sides within the crush chamber 12. Depending on the number of springs loaded on to the open chamber door 18, closing of the chamber door 18, provides the first compression of the springs in a direction parallel to an axis formed through the springs.

In a step 108, a second compression of the springs initiates with displacement of the vertical compression plates 14 in a downward direction by the vertical compression hydraulic cylinders 15. A downward displacement of the vertical compression plates 14 results in a decrease in the height of the crush chamber 12 and a second compression of the springs in a direction approximately perpendicular to an axis formed through the springs. Upon displacement of the vertical compression plates 14 to a desired height above the vertical compression counter surface 16, for example a height of 6 inches above the vertical compression counter surface 16, vertical compression ceases.

While maintaining the vertical compression plates 14 at the desired height above the vertical compression counter surface 16, in a step 110, the horizontal compression plate 36 is transposed horizontally through the bottom portion of the crush chamber 12 so as to compress the springs in a third direction. It will be understood that the third compression compresses the springs in a direction approximately perpendicular to an axis formed through the springs and in a direction approximately perpendicular to the direction of the second compression. Horizontal compression ceases once a desired hydraulic pressure in the horizontal compression hydraulic cylinder 38 is achieved.

In a step 112, the compressed mattress springs are then discharged from the crush chamber 12 by retracting, lifting, or otherwise displacing of the discharge door 34 so as to form an opening at one side of the lower crush chamber 12. The compressed mattress springs are discharged from the crush chamber 12 by additional horizontal displacement of the horizontal compression plate 36 towards the opening formed by the now retracted discharge door 34. The compressed springs can be discharged from the crush chamber 12 on to a cart, conveyor belt, truck or other means for facilitating the transportation of the compressed springs to a foundry.

In certain embodiments of the present invention, the compressed mattress springs may be bundled or otherwise confined such that the compressed springs better maintain their compressed state and/or to facilitate handling and transport of the compressed springs.

In certain embodiments of the present invention, compression of the mattress springs is facilitated through hydraulic displacement of certain interior surfaces of the crush chamber 12. In a preferred embodiment, the hydraulic displacement is achieved by employing a motor 40, for example, an electric motor of ten horsepower. However, it is noted that other suitable manners of achieving displacement of the surfaces of the crush chamber 12 and other suitable means for powering such displacement are well known in the art and may also be employed to achieve similar results.

In certain other embodiments of the present invention, the spring compactor 10 may be operated manually through the use of valve controls 42, shown in FIG. 3. Alternatively, operation may be automated such that after loading the springs on to the open chamber door 18, an operator need only actuate a button of lever to begin an automated compression cycle that results in the discharge of a mass of compressed metal springs of a density accepted by metal foundries.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A method for preparing springs from a mattress and/or box spring for processing by a foundry comprising the following steps performed in the order provided:

separating a metal spring from a mattress or box spring from non-spring elements of the mattress or box spring;

placing the metal spring horizontally onto an elevated planar surface formed by a pivotable door of a crush chamber;

compressing the metal spring in a first direction substantially parallel with an axis through the metal spring by advancing the door of the crush chamber to a closed position, wherein closing the door positions the metal spring vertically upon its long side within the crush chamber;

compressing the metal spring in a second direction;

compressing the metal spring in a third direction;

discharging the metal spring from the crush chamber in a direction parallel with the third direction.

2. The method of claim 1 wherein the step of compressing the metal spring in a first direction by advancing the door of the crush chamber to a closed position comprises transposing the chamber door to a vertical position.

3. The method of claim 1 wherein the step of compressing the metal spring in a second direction comprises compressing the metal spring in a direction perpendicular to an axis through the metal spring.

4. The method of claim 1 wherein the step of compressing the metal spring in a third direction comprises compressing the metal spring in a direction perpendicular to an axis through the metal spring.

5. The method of claim 1 wherein the step of discharging the metal spring from the crush chamber in a direction parallel with the third direction comprises discharging a rectangular mass of metal having a density of 60-100 pounds per cubic foot.

* * * * *